US006065873A

United States Patent [19]

Fowler

[11] Patent Number: 6,065,873

[45] Date of Patent: May 23, 2000

[54] FOLDABLE SELF-STANDING CARRY-ALL

[76] Inventor: Margaret E. Fowler, #218 - 2377 Shannon Woods Drive, Westbank, British Columbia, Canada, V4T 2L8

[21] Appl. No.: 09/260,137

[22] Filed: Mar. 1, 1999

[51] Int. Cl.[7] ..... B65D 30/16

[52] U.S. Cl. ..... 383/104; 383/10; 383/33; 383/93; 383/107

[58] Field of Search ..... 383/2, 10, 33, 383/35, 78, 89, 93, 95, 104, 107; 153/900; 190/107

[56] References Cited

U.S. PATENT DOCUMENTS

| | | | |
|---|---|---|---|
| 1,623,107 | 4/1927 | Goodykoontz . | |
| 2,010,267 | 8/1935 | Klotz | 383/33 X |
| 2,010,428 | 8/1935 | Finkelstein | 383/107 X |
| 2,325,853 | 8/1943 | Harlem . | |
| 2,457,422 | 12/1948 | Warner | 383/2 |
| 2,694,812 | 11/1954 | Neuburger . | |
| 3,659,775 | 5/1972 | Truman . | |
| 3,682,372 | 8/1972 | Rodley . | |
| 3,715,074 | 2/1973 | Michel . | |
| 3,738,565 | 6/1973 | Ackley et al. . | |
| 3,917,159 | 11/1975 | Platz . | |
| 4,059,222 | 11/1977 | Gamble | 383/95 X |
| 4,248,364 | 2/1981 | Anderson | 383/33 X |
| 4,691,368 | 9/1987 | Roessiger | 383/93 X |
| 4,848,930 | 7/1989 | Williams et al. . | |
| 5,024,344 | 6/1991 | Paula . | |
| 5,062,717 | 11/1991 | Shockley . | |
| 5,080,643 | 1/1992 | Mitchell et al. . | |
| 5,158,371 | 10/1992 | Moravek . | |
| 5,273,362 | 12/1993 | Buchanan . | |
| 5,716,138 | 2/1998 | Southwell . | |
| 5,788,378 | 8/1998 | Thomas . | |

FOREIGN PATENT DOCUMENTS

| | | | |
|---|---|---|---|
| 242185 | 8/1924 | Canada . | |
| 2164547 | 3/1986 | Germany | 383/33 |

*Primary Examiner*—Jes Pascua
*Attorney, Agent, or Firm*—Antony C. Edwards

[57] ABSTRACT

A soft-sided fabric container, which in an open position is parallelepiped-shaped, has opposed side walls, opposed end walls mounted to the side walls at opposed longitudinal ends of the side walls, and a bottom wall opposite an open top of the container. The side wall edges, elongate rigid members mounted thereto. Handle apertures are formed in the side walls adjacent the rigid members. Resilient stiffeners are mounted along longitudinally opposite edges of the side walls from the bottom wall to the rigid members for resiliently urging the side walls each into a generally planar shape.

3 Claims, 2 Drawing Sheets

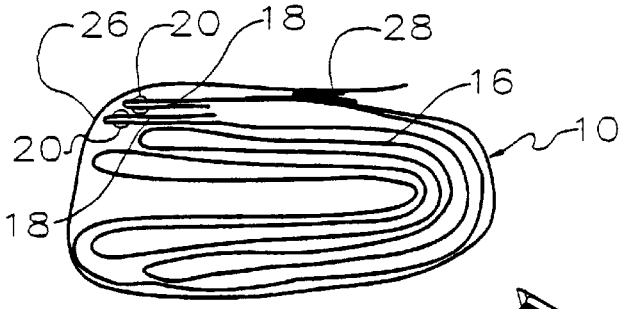
Fig 1
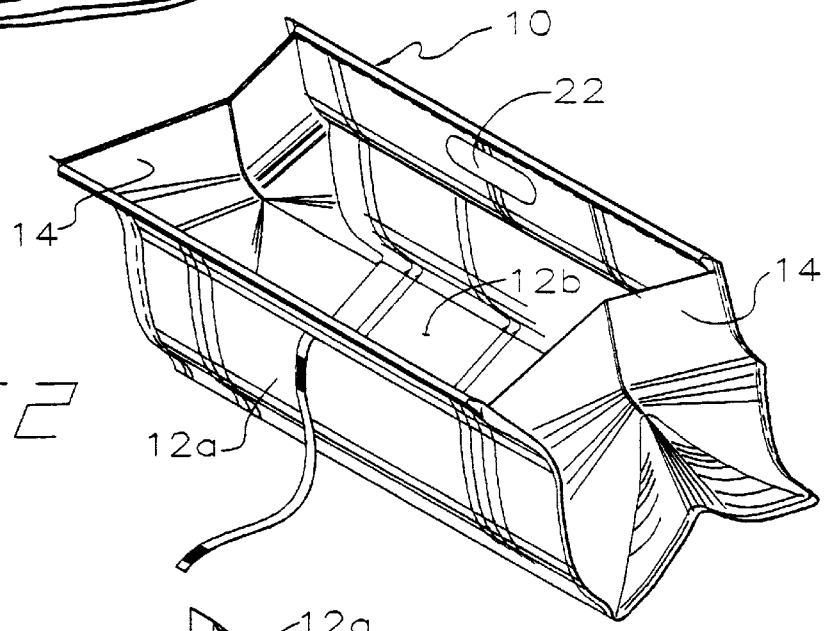
Fig 2
Fig 3
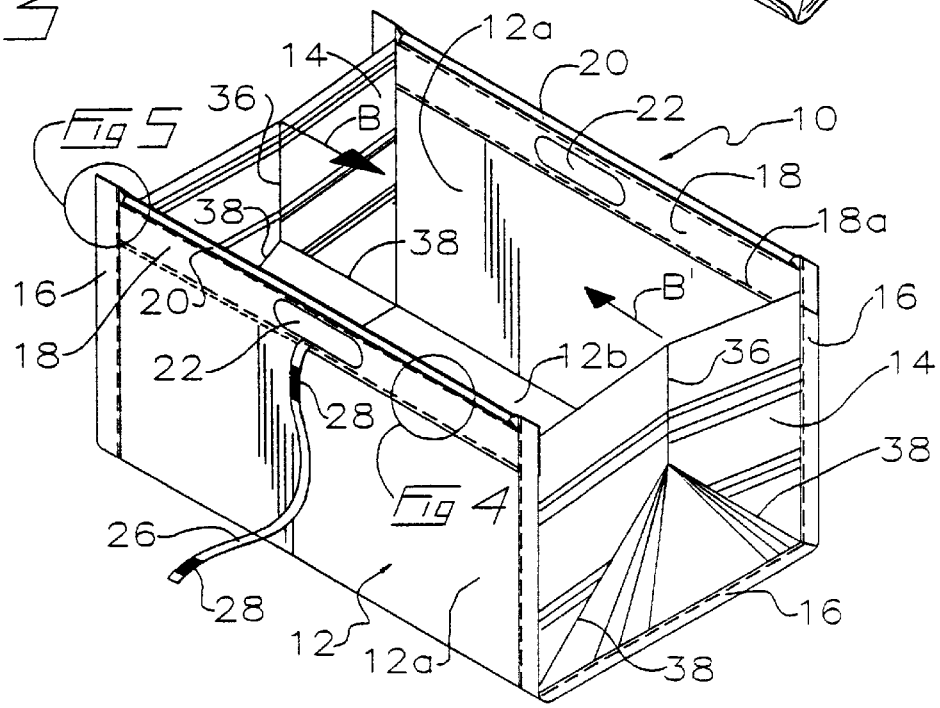
Fig 5
Fig 4

FOLDABLE SELF-STANDING CARRY-ALL

FIELD OF THE INVENTION

This invention relates to the field of open-topped carry-alls of flexible plasticized material which can be stored in a compact folded condition and readily expandable for filling, and in particular, a carry-all which retains its expanded shape when in its open position.

BACKGROUND OF THE INVENTION

There has in the past been some inherent problems associated with flexible containers, bags, or carry-alls of the type generally used for holding and transporting household articles, recycling materials, groceries and the like. Generally the problems associated with the presently available flexible sided containers or carry-alls is that they are flimsy, not durable, and do not retain their shape when in an open position, making them somewhat difficult to fill. Due to their design and shape they are unstable when filled and placed inside a vehicle for transportation. In addition, the bulk purchase and transportation of goods such as groceries, generally result in an inefficient single use of plastic grocery bags which are capable of being used several times. In many cases, due to the shape and weight of grocery packaging double bagging is necessary. This raises concern surrounding the manufacturing and disposal of larger volumes of plastic materials.

It is therefore an object of this invention to provide a reusable flexible sided carry-all which can be stored in a convenient and compact rolled up state, and which can be easily unfolded to an open position, and when in the open position will retain its shape for ease of filling.

SUMMARY OF THE INVENTION

The present invention is a flexible self-standing carry-all. It is a soft-sided fabric container which in an open position is parallelepiped-shaped, advantageously a rectangular parallelepid. It includes opposed first and second side walls, and opposed first and second end walls mounted to the first and second side walls at opposed longitudinal ends of the first and second side walls so as to extend between the first and second side walls. A bottom wall, opposite to an open top of the container, extends between the first and second side walls and between the first and second end walls, and is mounted thereto at bottom edges thereof. The side walls have first and second upper edges, corresponding to the first and second side walls. Longitudinal rigid members such as dowels are mounted to the upper edges. First and second handle apertures may be formed in corresponding first and second side walls, adjacent the longitudinal rigid members.

First resilient stiffeners are mounted along longitudinally opposite edges of the first and second walls from the bottom wall to the longitudinal rigid members for resiliently urging the first and second side walls each into a generally planar shape. The first resilient stiffeners may be resilient fabric seam covers mounted over seams between the first and second side walls and the first and second end walls, advantageously also made of heavy woven polyethylene.

In one preferred embodiment the first and second side walls and the bottom wall are formed from a single unitary piece of fabric, which may, in one aspect of the invention be heavy woven polyethylene.

In a further aspect of the present invention the carry-all includes at least one flexible elongate tie strap mounted at one end thereof to one of the first or second side walls, advantageously, in one embodiment, adjacent the upper edges of the side walls.

In yet a further aspect, the carry-all further comprises interior first and second side walls liners mounted, respectively, to interior surfaces of the first and second side walls. The liners are mounted along corresponding first and second fold-lines generally adjacent the side walls first and second upper edges. The side wall liners may hang freely parallel to the interior surfaces of the side walls or may be folded upwardly to form a cover over the open top of the container.

BRIEF DESCRIPTION OF THE DRAWINGS

FIG. 1 is an end view of the flexible sided carry-all of the present invention in a collapsed and folded up position for storage.

FIG. 2 is an isometric view of the carry-all of the present invention in a partially opened position.

FIG. 3 is an isometric view of the carry-all of FIG. 2 in a fully opened position.

DETAILED DESCRIPTION OF PREFERRED EMBODIMENTS

As illustrated in FIGS. 2 and 3, carry-all 10 comprises a unitary enclosure piece 12 which when wrapped around, and stitched along, the perimeter of end walls 14 forms the container of carry-all 10. Unitary enclosure piece 12 is a single piece of fabric having sufficient flexibility when the edges of piece 12 are attached to end walls 14, such as by sewing, side walls 12*a* and a bottom portion 12*b* are formed to allow it to be folded and rolled-up, but sufficiently rigid to assist the free-standing characteristic of carry-all 10. In one embodiment piece 12 and end walls 14 are made of tarpaulin-weight woven polyethylene. Thus piece 12 when attached to end walls 14 form an open topped container or carry-all which may be generally cubic or parallelepiped in shape in its open position as seen in FIG. 3. The vertical height of walls 12*a* may in one embodiment be approximately equal to the shortest horizontal width of bottom 12*b*. This design provides stability to the carry-all and reduces the tendency for tip over and spilling of the contents.

Figure 4:
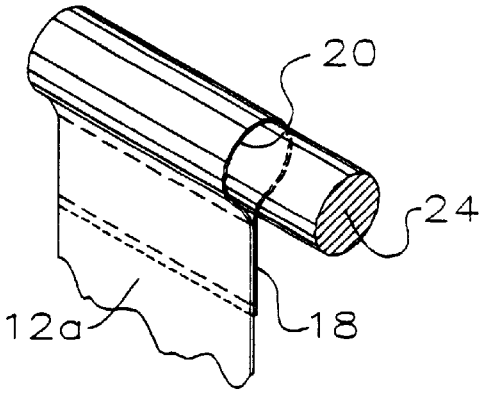
FIG. 4 is an enlarged partially cut-away view of the handle portion of the carry-all of FIG. 3.
Figure 5:
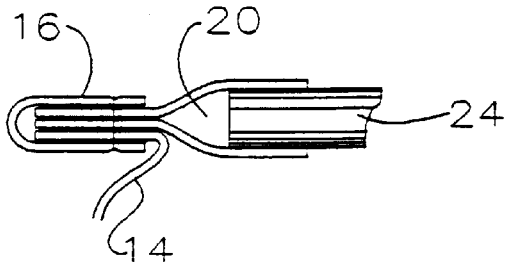
FIG. 5 is an enlarged partially cut-away view of a seam portion of the carry-all of FIG. 3.
Figure 6:
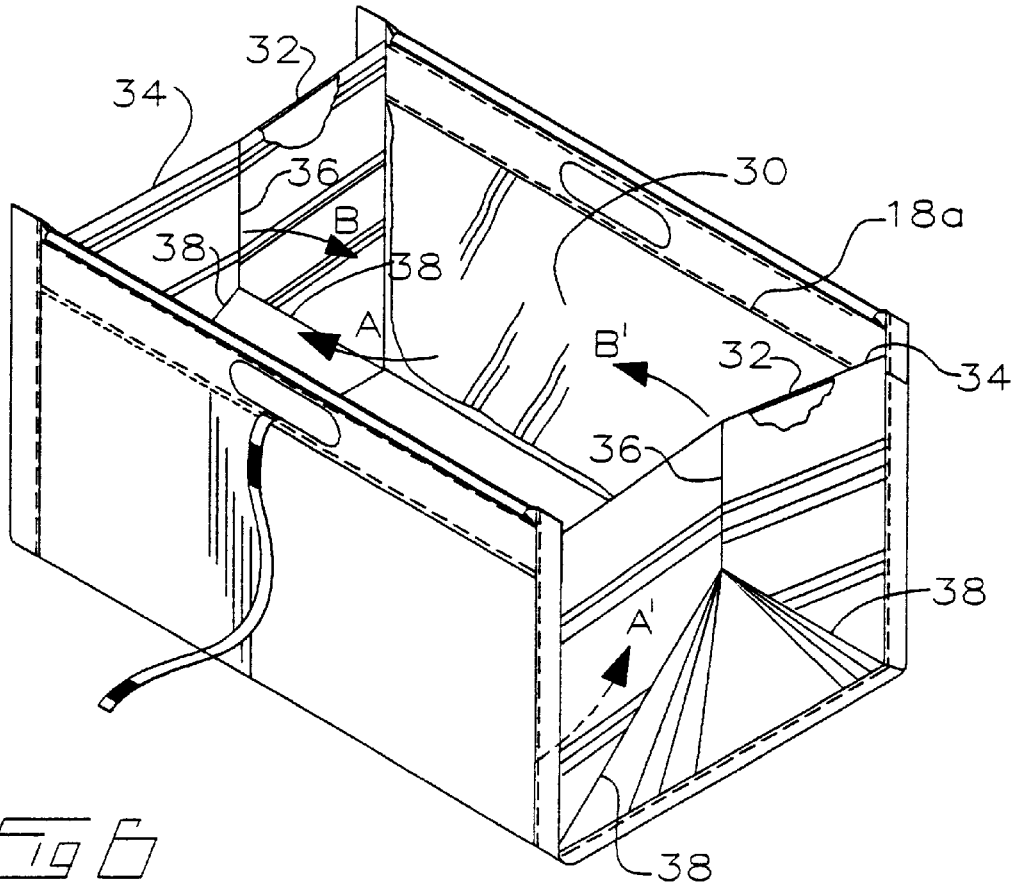
FIG. 6 is the carry-all of FIG. 3 in an alternative embodiment.

Alternatively, carry-all 10 may have different dimensions including a height which in the open position exceeds the width of bottom 12*b*. An additional strip of fabric which may be a strip of heavy woven polyethylene, is advantageously sewn or otherwise affixed over the seam between the edges of end walls 14 and the edges of piece 12. This strip of fabric forms edge stiffener 16 as better understood in reference to FIG. 5. Stiffener 16 lends rigidity to the horizontal and vertical seams at the edges of end walls 14, and assists in maintaining the carry-all in an open and upright position when opened by the user, that is, assists in maintaining side walls 12*a* generally vertical, or at least generally planar should the side walls pivot inwardly into a tented position with the upper edges of the side walls resting against one another.

The upper longitudinal edges of side walls 12*a* are formed, for example by folding, and sewn to provide a broad upper seam 18 and a longitudinal sleeve 20. Seams 18 have apertures 22 therethrough to assist a user in gripping the carry-all. Apertures 22 in one embodiment are intermediate end walls 14. A wooden dowel 24 is contained in each sleeve 20 to provide further stiffening of the side walls and strengthening of the handles provided by apertures 22. Seams 18 and dowels 24 provide longitudinal rigidity to the carry-all without interfering with rolling-up of the carry-all into its closed position as illustrated in FIG. 1.

A tie strap 26 is sewn into, or otherwise affixed to, upper seam 18. Hook and loop releasable fasteners such as Velcro™ strips 28 or other releasable fasteners are provided on tie strap 26 to facilitate an efficient and quick securing of the carry-all in its folded down and rolled position as seen in FIG. 1. Alternatively, instead of a single tie strap 26 having releasable fasteners, a pair of tie straps are employed which are wrapped in opposed directions around the rolled-up carry-all and knotted or tied in a bow at their distal ends.

To utilize the carry-all, the tie strap 26 is released and the users fingers of each hand (not shown) are inserted through corresponding grip apertures 22 in opposite side walls 12 and the sidewalls shaken outwardly to an extended position. A snap of the wrists and the carry-all is generally fully open into its open position. In one method of efficiently opening carry-all 10, the carry-all is fully opened by firstly, inserting the fingers of each hand through the grip aperture 22 on each side seam 18, the users arms are extended outwardly, forwardly of the users body, to approximately shoulder height. The operators thumbs are then rotated back toward the body, thereby inverting the upper opening of the carry-all. That is, by this action the carry-all is turned with its open end facing downwards. A brisk downward motion fills the carry-all with air, thereby opening the lower extremities of the side walls and end walls. The carry-all may then be righted and bottom 12*b* placed upon a firm surface. Placing the opened carry-all on a floor, counter, or bottom of a shopping car, and releasing the handles, frees the user to begin loading items into the carry-all as the side walls will maintain their planar shape once the carry-all is fully open.

In one alternative embodiment, the inwardly folded sides of seams 18 extend beyond seam-line 18*a* downwardly into the carry-all, parallel to side walls 12*a* to form side wall liners 30. Side wall liners 30 may be left hanging down parallel to the side walls in opposed facing relation and thereby provide an insulating factor to the side walls when the carry-all is being used as a cooler. The upper edges of the side walls along sleeves 20 may be drawn together to increase the insulating effect. If the items in the carry-all are bulky, side wall liners 30 may each be folded upwardly in directions A and A' about seam-lines 18*a*, which act as hinges, to provide overlapping covers which extend across the carry-all opening.

A pair of stiffener wires 32 may, in a further embodiment, be mounted into the upper edge seams 34 along the upper edges of end walls 14. Stiffener wires 32 may be of light resilient spring wire or the like so that when the carry-all is in its open position, the side walls are urged apart. When it is desired to return the carry-all to its closed position, stiffener wires 32 do not significantly resist the inward folding of end walls 14 along fold lines 36 as the end walls are collapsed inwardly along fold lines 36 and 38 in directions B and B'. Alternatively, stiff seam covers such as used for stiffeners 16 may be employed along seams 34 to assist maintaining the carry-all handles spaced apart for ease of loading of the carry-all.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A carry-all comprising:

a soft-sided fabric container which in an open position is parallelepiped-shaped so as to include opposed first and second side walls, opposed first and second end walls mounted to said first and second side walls at opposed longitudinal ends of said first and second side walls so as to extend between said first and second side walls, a bottom wall opposite an open top of said container, said bottom wall extending between said first and second side walls and between said first and second end walls and mounted thereto at bottom edges thereof, first and second upper side wall edges, corresponding to said first and second side walls, having longitudinal rigid members mounted thereto, first resilient stiffeners mounted along longitudinally opposite edges of said first and second side walls from said bottom wall to said longitudinal rigid member for resiliently urging said first and second side walls each into a generally planar shape, wherein said first resilient stiffeners are resilient fabric seam covers mounted over seams between said first and second side walls and said first and second end walls.

2. The carry-all of claim 1 wherein said resilient fabric seam covers are made of heavy woven polyethylene.

3. A carry-all comprising:

a soft-sided fabric container which in an open position is parallelepiped-shaped so as to include opposed first and second side walls, opposed first and second end walls mounted to said first and second side walls at opposed longitudinal ends of said first and second side walls so as to extend between said first and second side walls, a bottom wall opposite an open top of said container, said bottom wall extending between said first and second side walls and between said first and second end walls and mounted thereto at bottom edges thereof, first and second upper side wall edges, corresponding to said first and second side walls, having longitudinal rigid members mounted thereto, first resilient stiffeners mounted along longitudinally opposite edges of said first and second side walls from said bottom wall to said longitudinal rigid members for resiliently urging said first and second side walls each into a generally planar shape, further comprising interior first and second side walls liners mounted, respectively, to interior surfaces of said first and second side walls along corresponding first and second fold-lines generally adjacent said first and second upper side wall edges, whereby said side wall liners may hang freely parallel to said interior surfaces or may be folded upwardly to form a cover over said open top of said container.

* * * * *